US010953302B2

(12) United States Patent
Harris et al.

(10) Patent No.: US 10,953,302 B2
(45) Date of Patent: Mar. 23, 2021

(54) GUARD TO LIMIT ABRASIONS DURING USE OF GYMNASTICS RINGS AND METHOD OF USING SAME

(71) Applicant: Palladium Safety Solutions, Inc., Saint Jacob, IL (US)

(72) Inventors: Mark Harris, Saint Jacob, IL (US); Dana Askew-Harris, Saint Jacob, IL (US)

(73) Assignee: PALLADIUM SAFETY SOLUTIONS, INC., Saint Jacob, IL (US)

( * ) Notice: Subject to any disclaimer, the term of this patent is extended or adjusted under 35 U.S.C. 154(b) by 30 days.

(21) Appl. No.: 16/451,694

(22) Filed: Jun. 25, 2019

(65) Prior Publication Data

US 2020/0001163 A1 Jan. 2, 2020

Related U.S. Application Data

(60) Provisional application No. 62/691,826, filed on Jun. 29, 2018.

(51) Int. Cl.
*A63B 71/00* (2006.01)
*A63B 7/02* (2006.01)

(52) U.S. Cl.
CPC ..... *A63B 71/0054* (2013.01); *A63B 7/02* (2013.01); *A63B 2071/009* (2013.01)

(58) Field of Classification Search
CPC . A63B 7/02; A63B 71/0054; A63B 2071/009; A63B 2209/00; A63B 2209/10; A63B 1/00; A63B 5/20; A63B 21/0608; A63B 21/607; A63B 21/4022; A63B 21/285; B66C 1/22; B65H 57/04
See application file for complete search history.

(56) References Cited

U.S. PATENT DOCUMENTS

| | | | | |
|---|---|---|---|---|
| 1,585,334 A | | 5/1926 | Ensor | |
| 4,756,527 A | | 7/1988 | Ledbetter | |
| 5,178,590 A | * | 1/1993 | Stephens | A63B 7/02 482/23 |

(Continued)

FOREIGN PATENT DOCUMENTS

| | | |
|---|---|---|
| CN | 2750829 U | 1/2006 |
| DE | 2548391 A1 | 6/1977 |

(Continued)

*Primary Examiner* — Nyca T Nguyen
*Assistant Examiner* — Andrew M Kobylarz
(74) *Attorney, Agent, or Firm* — Thompson Coburn LLP

(57) ABSTRACT

A ring guard is provided as a sleeve with first and second width edges and a length extending between the width edge. The sleeve first width edge is open into an interior of the sleeve. The sleeve first width edge is configured to receive a strap of a gymnastics ring into an interior of the sleeve. The second width edge has a loop. The loop has a distal end with a releasable connector. The loop distal end releasable connector is releasably connectable with the sleeve at the second width edge in a manner such that when the loop is directed through an inner diameter of a gymnastics ring, the loop holds the sleeve in position relative to the gymnastics ring. The sleeve may have releasable connectors to allow the sleeve to be arranged around the gymnastics ring strap with the loop around the gymnastics ring.

15 Claims, 9 Drawing Sheets

(56) References Cited

U.S. PATENT DOCUMENTS

| | | | | |
|---|---|---|---|---|
| 5,724,698 | A * | 3/1998 | Mondragon | A47K 10/02 15/209.1 |
| 5,743,838 | A * | 4/1998 | Willis | A63B 21/0552 482/124 |
| 7,291,099 | B1 | 11/2007 | Marczewski | |
| 7,651,448 | B2 | 1/2010 | Hetrick | |
| 7,762,932 | B2 | 7/2010 | Hetrick | |
| 7,785,244 | B2 | 8/2010 | Hetrick | |
| 7,806,814 | B2 | 10/2010 | Hetrick | |
| 9,345,922 | B2 | 5/2016 | Allison et al. | |
| 9,486,663 | B2 | 11/2016 | DeMarco et al. | |
| 9,839,805 | B2 | 12/2017 | Demarco et al. | |
| 9,914,005 | B2 | 3/2018 | Zadman-Zeman | |
| 10,537,763 | B2 * | 1/2020 | Turner | B65H 75/486 |
| 2009/0075790 | A1 | 3/2009 | Hetrick | |
| 2009/0093344 | A1 | 4/2009 | Rastegar et al. | |
| 2009/0105053 | A1 | 4/2009 | Hetrick | |
| 2010/0323852 | A1 | 12/2010 | Locsin | |
| 2013/0029810 | A1 * | 1/2013 | Olivencia | A63B 71/1225 482/93 |
| 2016/0256728 | A1 | 9/2016 | Tang | |
| 2017/0296856 | A1 | 10/2017 | Burke | |

FOREIGN PATENT DOCUMENTS

| | | | |
|---|---|---|---|
| DE | 202011110938 | U1 | 6/2017 |
| GB | 377413 | A | 7/1932 |
| GB | 2541402 | A | 2/2017 |
| RU | 115221 | U1 | 4/2012 |
| RU | 115222 | U1 | 4/2012 |
| RU | 115223 | U1 | 4/2012 |
| RU | 116054 | U1 | 5/2012 |
| RU | 117300 | U1 | 6/2012 |
| RU | 124582 | U1 | 2/2013 |
| WO | 2013/045162 | A1 | 4/2013 |
| WO | 2014/133879 | A1 | 9/2014 |

* cited by examiner

GUARD TO LIMIT ABRASIONS DURING USE OF GYMNASTICS RINGS AND METHOD OF USING SAME

CROSS-REFERENCE TO RELATED APPLICATIONS

This application claims the benefit of U.S. provisional application Ser. No. 62/691,826, filed Jun. 29, 2018, the disclosure of which is incorporated herein by reference.

SUMMARY

The disclosure is directed to a guard that covers over the straps, buckles, and fasteners associated with gymnastics rings. When installed over the straps, buckles, and fasteners associated with gymnastics rings, the ring guard limits abrasions during the use of gymnastics rings. The disclosure is also directed to a method of using such a ring guard. The ring guard is made from a smooth flexible material such as neoprene or other similar material having a smooth outer surface. The smooth outer surface serves to limit friction and thus abrasions to which a user may be subjected when the user's arms and torso contact the ring guard. Thus, the ring guard tends to reduce the severity of the abrasions that a user may otherwise be subjected to from contact with the straps, buckles, and fasteners associated with gymnastics rings.

DETAILED DESCRIPTION

Figure 1:
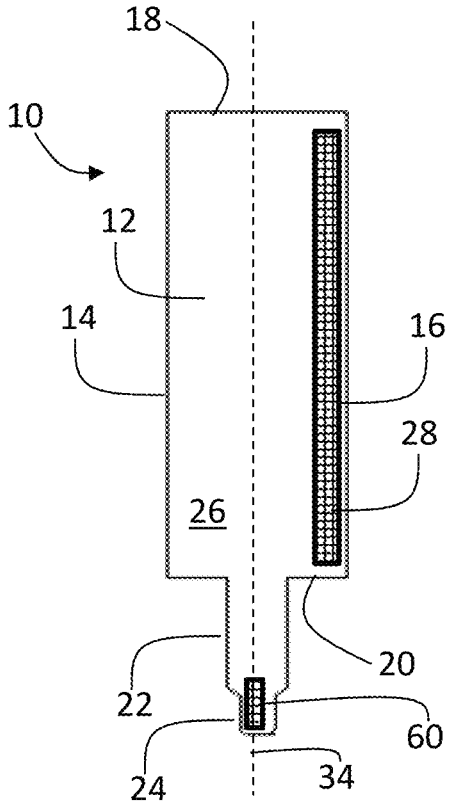
FIG. 1 is a top plan view of an exemplary ring guard.
Figure 2:
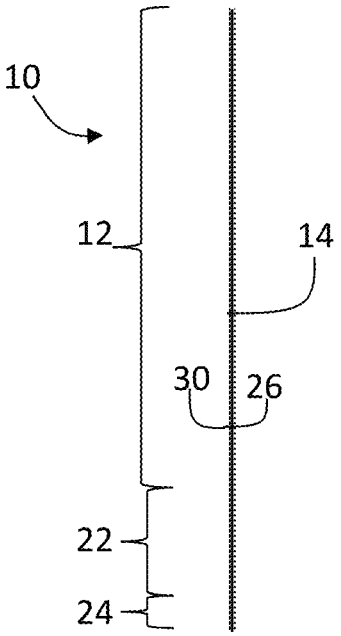
FIG. 2 is a left side view of the ring guard of FIG. 1.
Figure 3:
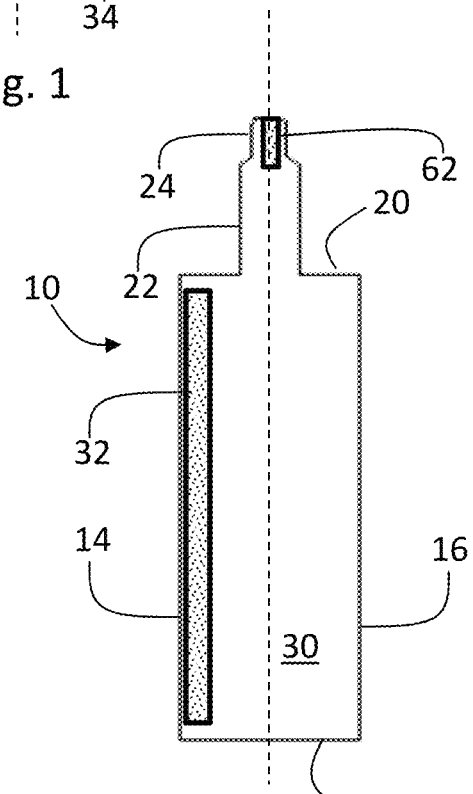
FIG. 3 is a bottom view of the ring guard of FIG. 1.

FIGS. 1-3 show an exemplary ring guard 10. The ring guard 10 may comprise a generally rectangular shaped pliant member 12 defined by opposite first and second longitudinal edges 14,16 spaced apart by first and second width edges 18,20. An extension portion 22 may project from the second width edge 20 and may be centered on the second width edge between the first and second longitudinal edges 14,16. The extension portion 22 may have a tab 24. The extension portion may also be a separate member from the pliant member and releasably attached to the pliant member when the pliant member is attached around the gymnastics ring strap at the gymnastics ring. The ring guard may also comprise a sleeve that is open at a width edge to allow a strap of a gymnastics ring to be received into an interior of the sleeve whereafter the extension member may be directed through the inner diameter of the gymnastics ring and joined to the sleeve to secure the sleeve in position relative to the gymnastics ring and strap.

In one configuration of the ring guard 10 shown in FIGS. 1-3, the pliant member 12 may be arranged in such a manner that a first or top side 26 (FIG. 1) may have a releasable connector 28, for instance, a loop material, adjacent to a longitudinal edge (e.g, the second longitudinal edge 16 shown in the FIGS. 1-6). The ring guard 10 may then be arranged in such a manner that a second or bottom side 30 (FIG. 3) may have a cooperating releasable connector 32, for instance, a hook material, adjacent to an opposite longitudinal edge (e.g., the first longitudinal edge 14 shown in FIGS. 1-6). With the releasable connector 28 on the longitudinal edge 16 on the first or top side 26 and the cooperating releasable connector 32 on the opposite longitudinal edge 14 of the second or bottom side 30, a first portion (e.g., a left portion) of the ring guard may be folded over a fold line 34 extending in a direction parallel to the longitudinal edges to form a first folded over region, and a second portion (e.g., a right portion) of the ring guard may be folded over the fold line to form a second folded over region. The second portion may then be releasably connected to the first portion thereby allowing the ring guard to be folded around a gymnastics ring 40 and the strap 50 and secured in place.

The releasable connectors 28,32 on the longitudinal edges 14,16 of the ring guard 10 may include hook and loop material, snap fasteners, buttons and button holes, a zipper, or other releasable mechanical fastening devices that provide a streamline profile for the ring guard when assembled with the gymnastics ring 40 and the strap 50.

The extension portion 22 and the tab 24 may be wrapped around a terminal end of the strap 50 and its connection with the gymnastics ring 40 to provide a more streamlined profile for the ring guard and maintain the position of the ring guard around the gymnastics ring and strap and to prevent the ring guard from freely sliding along the strap. The extension also provides a smooth surface which limits the abrasions that the user may be subjected to from contact with connection of the gymnastics ring 40 and the terminal end of the strap 50. As shown in the drawings, the tab 24 of the extension portion 22 may have releasable connectors 60,62 on the top and bottom sides 26,30 to releasably connect the tab to the exposed releasable connector of first folded portion (e.g., the releasable connector 32 on the second or bottom side 30 of the ring guard and first longitudinal edge 14), and allow the releasable connector of the second folded portion (e.g., the releasable connector 28 on the first or top side 26 of the ring guard and first longitudinal edge 16), to engage the opposite side of the tab and cover around the connection of the gymnastics ring and the strap. By way of example, the first or top side of the tab may be the same type of releasable connector as the first or top side longitudinal edge (e.g., a loop material), and the second or bottom side of the tab may be the same type of releasable connector as the second or bottom side longitudinal edge (e.g., a hook material). As mentioned before, the extension and tab may be a separate member from the pliant member and may be releasably connected around the gymnastics ring to the pliant member to maintain the pliant member in position relative to the gymnastics ring and strap.

Figure 4:
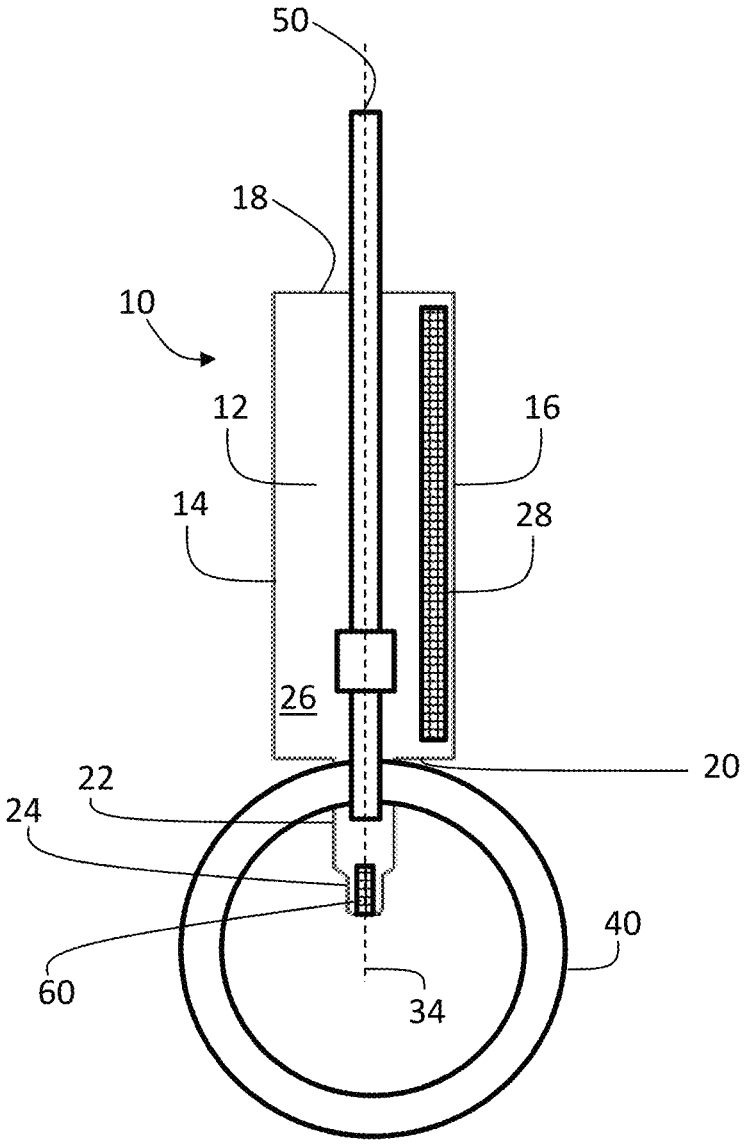
FIG. 4 shows a step of a method of using the ring guard of FIG. 1 wherein the ring guard is placed adjacent to a gymnastics ring and strap.
Figure 5:
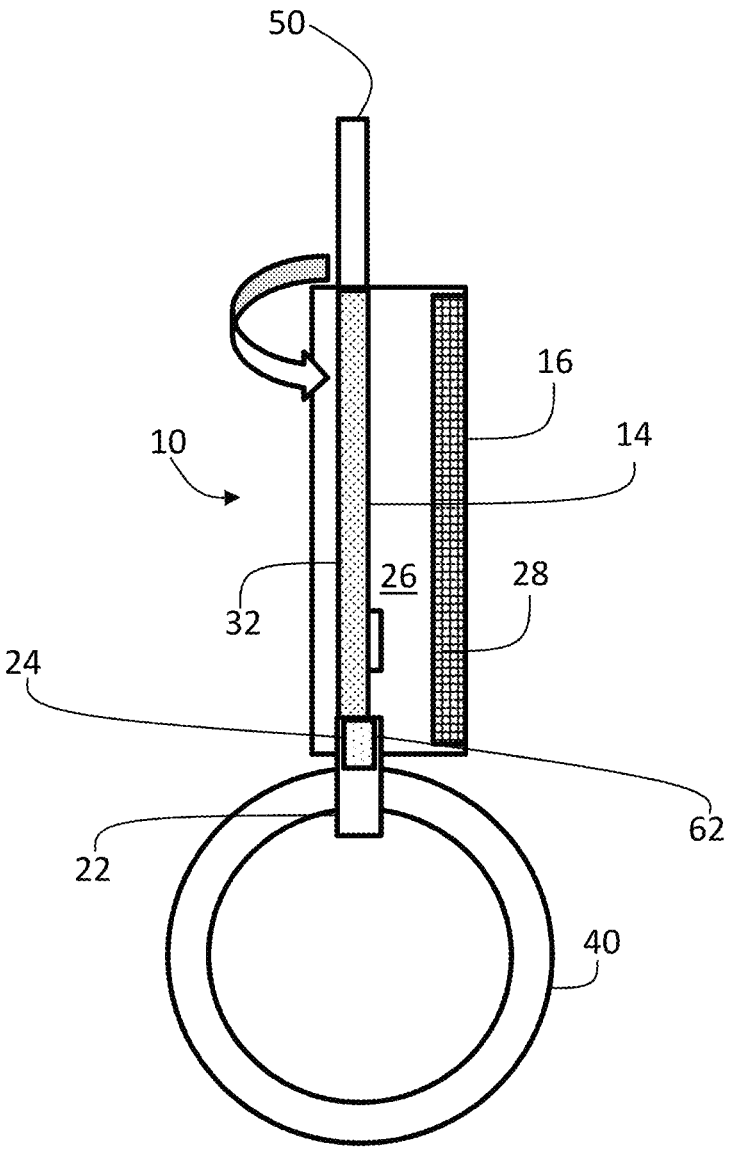
FIG. 5 shows another step of a method of using the ring guard of FIG. 1 wherein a first portion of the ring guard is folded over the strap and an extension of the ring guard is folded around the gymnastics ring.
Figure 6:
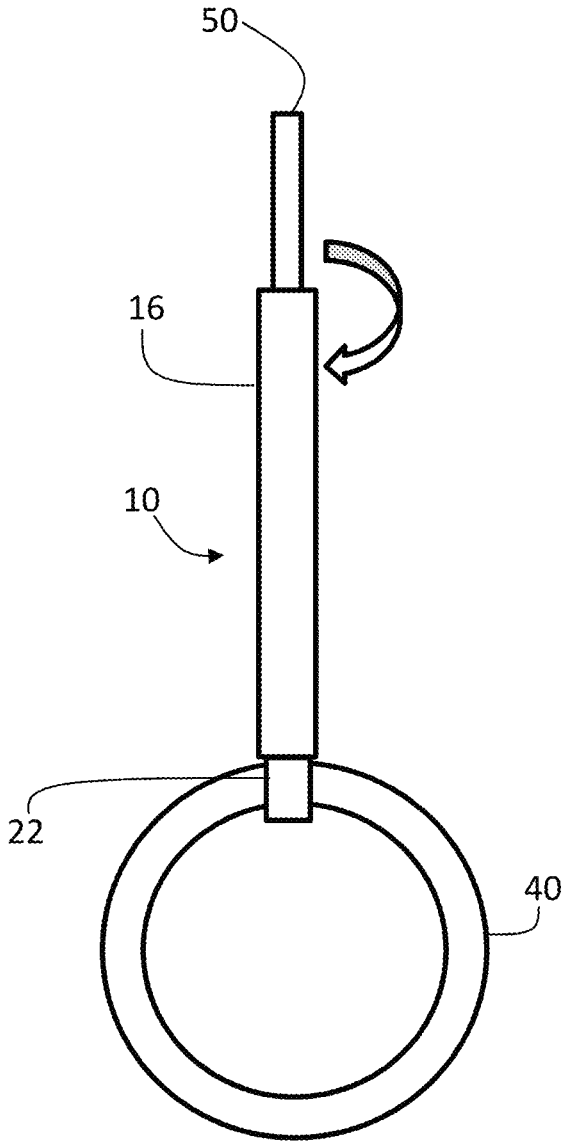
FIG. 6 shows another step of a method of using the ring guard of FIG. 1 wherein a second portion of the ring guard is folded over and joined to the first portion and the extension of the ring guard to cover over the strap and its connection point with the gymnastics ring.

Referring to FIGS. 4-6, in one aspect of a method, the ring guard 10 may be arranged relative to the strap 50 and gymnastics ring 40 such that the strap 50 is parallel to the longitudinal edges 14,16 of the ring guard 10 and positioned in the center of the ring guard with the extension portion 22 positioned to wrap around the connection of the terminal end of the strap and the gymnastics ring 40. As shown in FIG. 5, the left portion of the ring guard 10 may be folded over the strap 50 to cover over the strap and form the first folded over region. The extension portion 22 may be directed through the inner diameter of the gymnastics ring 50 and connected with the folded over left portion. The top surface of the extension and tab may abut the gymnastics ring. The releasable connector 60 on the tab 24 may cooperate with the releasable connector 32 on the longitudinal edge 14 of the second or bottom side 30. Referring to FIG. 6, the right portion of the ring guard 10 may be folded over to form a second folded over region, and connected to the left portion of the ring guard. The releasable connector 28 on the longitudinal edge 16 on the first or top side 26 may connect with the cooperating releasable connector 32 on the opposite longitudinal edge 14 of the second or bottom side 30, and the releasable connector 62 on the tab 24, thereby securing the ring guard in place around the strap and the gymnastics ring. While the drawings show the fold line 34 generally centered on the strap, that is not necessary, and the fold line for the first and/or second folded over region may be elsewhere depending upon a desired the position of the longitudinal edges.

Figure 7:
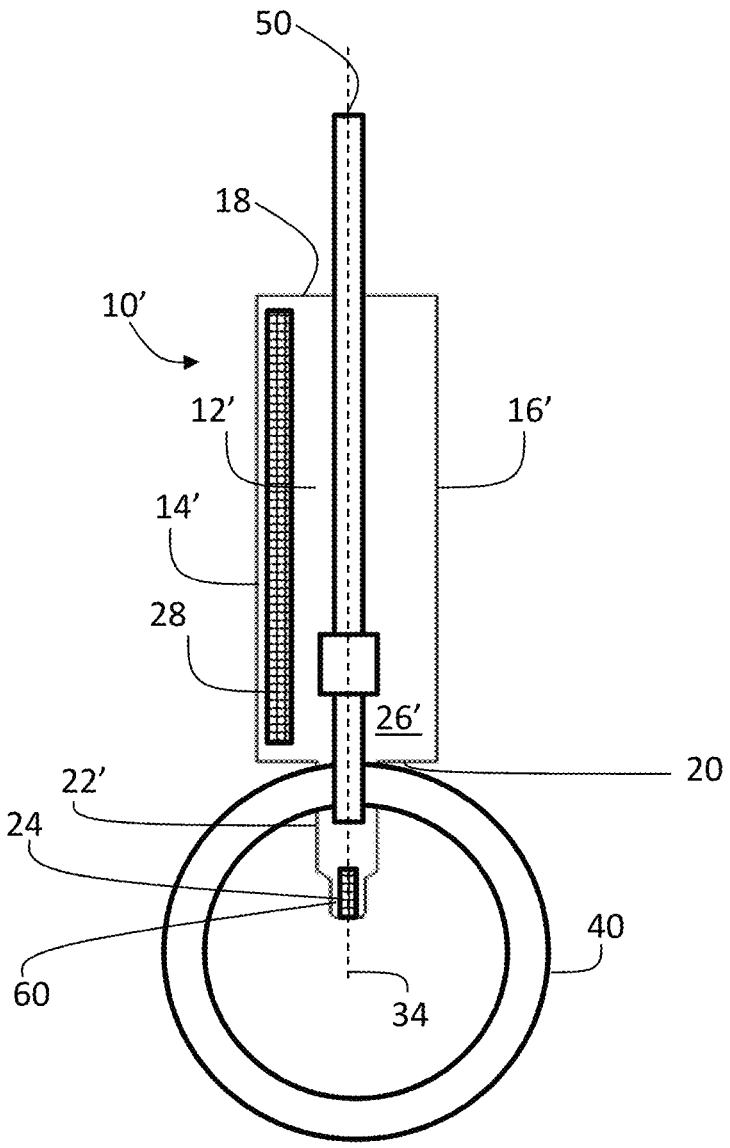
FIGS. 7-9 show steps of a method of using the ring guard having releasable connectors shown in a reversed configuration relative to the ring guard of FIG. 1 with the ring guard placed adjacent to a gymnastics ring and strap (FIG. 7), a first (e.g., right) portion of the ring guard folded over the strap and an extension of the ring guard folded around the gymnastics ring (FIG. 8), and a second (e.g. left) portion of the ring guard folded over and joined to the first portion and the extension of the ring guard to cover over the strap and its connection point with the gymnastics ring (FIG. 9).
Figure 8:
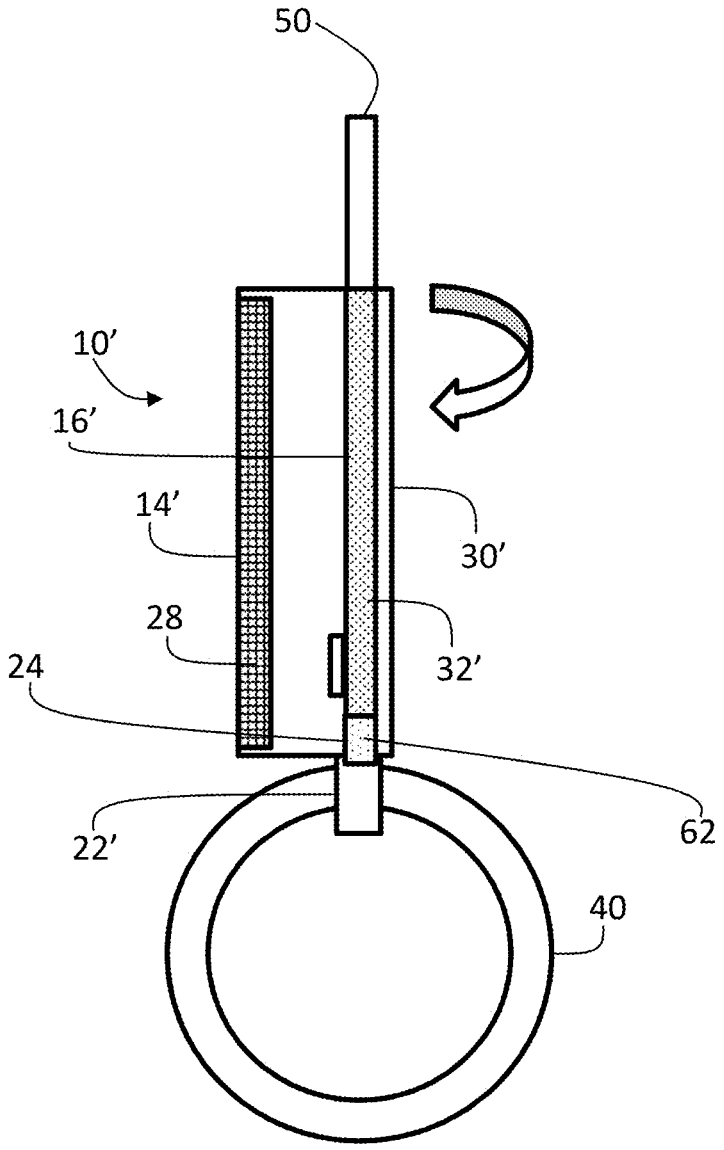
Figure 9:
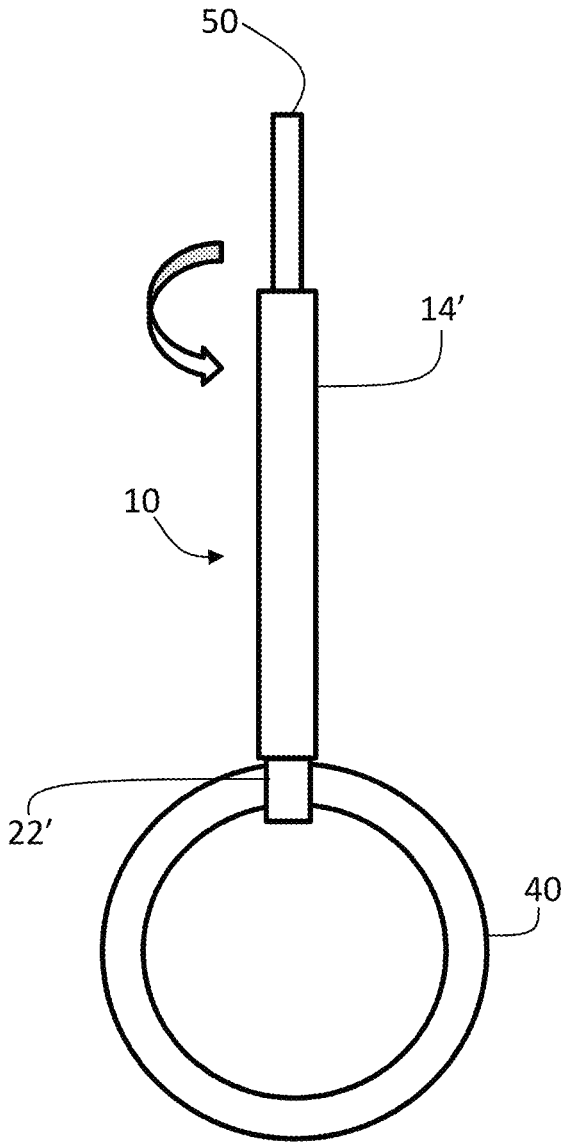

An alternate folding pattern may be used depending upon the arrangement of the releasable connectors on the pliant member. For instance, as shown by way of example in the FIGS. 7-9, a pattern that is reversed from that of FIGS. 4-6 may be used. Referring to FIG. 7, the ring guard 10' may be arranged relative to the strap 50 and gymnastics ring 40 such that the strap 50 is parallel to the longitudinal edges 14',16' of the ring guard 10' and positioned in the center of the ring guard with the extension portion 22' positioned to wrap around the connection of the terminal end of the strap and the gymnastics ring 40. As shown in FIG. 8, the right portion of the ring guard 10' may be folded over the strap 50 to cover over the strap. The extension portion 22' may be directed through the inner diameter of the gymnastics ring 50 and connected with the folded over right portion. The releasable connector 60 on the tab 24 may cooperate with the releasable connector 32' on the longitudinal edge 16' of the second or bottom side 30'. Referring to FIG. 9, the left portion of the ring guard 10' may be folded over and connected to the right portion of the ring guard. The releasable connector 28' on the longitudinal edge 14' on the first or top side 26' may connect with the cooperating releasable connector 32' on the opposite longitudinal edge 16' of the second or bottom side 30', and the releasable connector 62 on the tab 24, thereby securing the ring guard in place around the strap and the gymnastics ring. The ring guard may be installed around the strap and gymnastics ring.

The folding pattern may be arranged in such a way as to provide a streamline profile for the ring guard and to prevent its disassembly with the strap and the gymnastics ring in the event of contact between the user and the ring guard during use. In that respect, the seam formed by folding over the left and right portions edges of the ring guard may be placed on the outside facing direction of the strap and gymnastics ring with the user positioning his/her body on the inside facing direction of the strap and gymnastics ring between side by side spaced apart straps and gymnastics rings.

Figure 10:
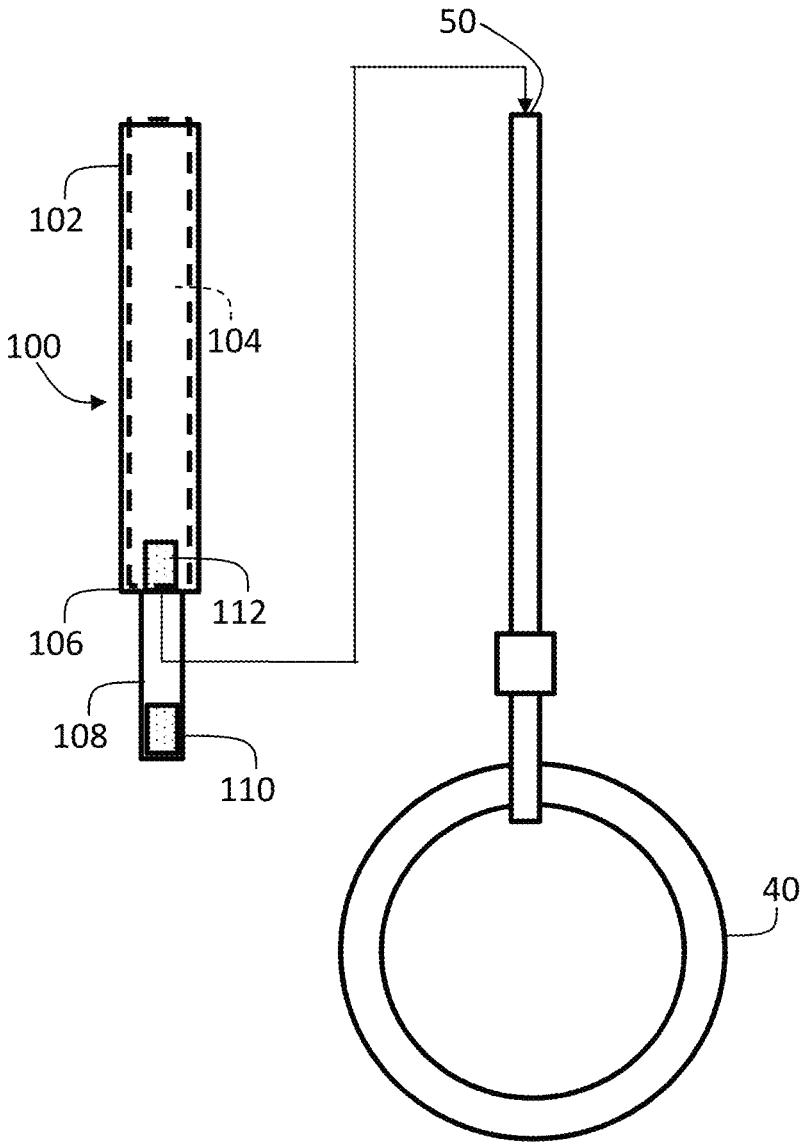
FIGS. 10-12 show steps of a method of using the ring guard formed as a sleeve with the ring guard placed adjacent to a gymnastics ring and strap (FIG. 10), the ring guard over the strap and an extension of the ring guard folded around the gymnastics ring (FIG. 11), and the ring guard over the strap and an extension of the ring guard joined to the sleeve to cover over the strap and its connection point with the gymnastics ring (FIG. 12).
Figure 11:
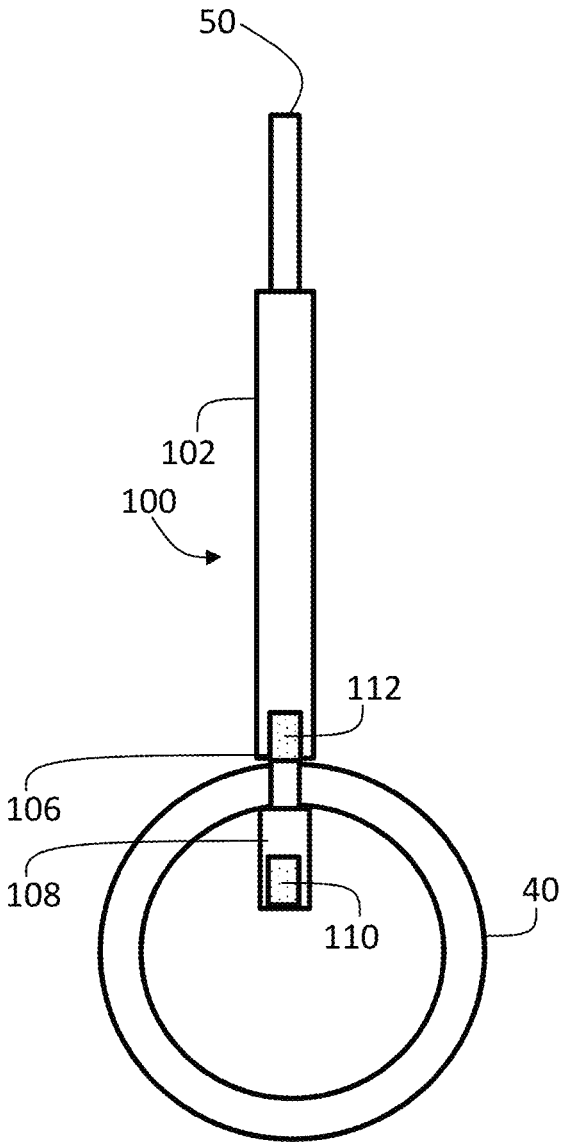
Figure 12:
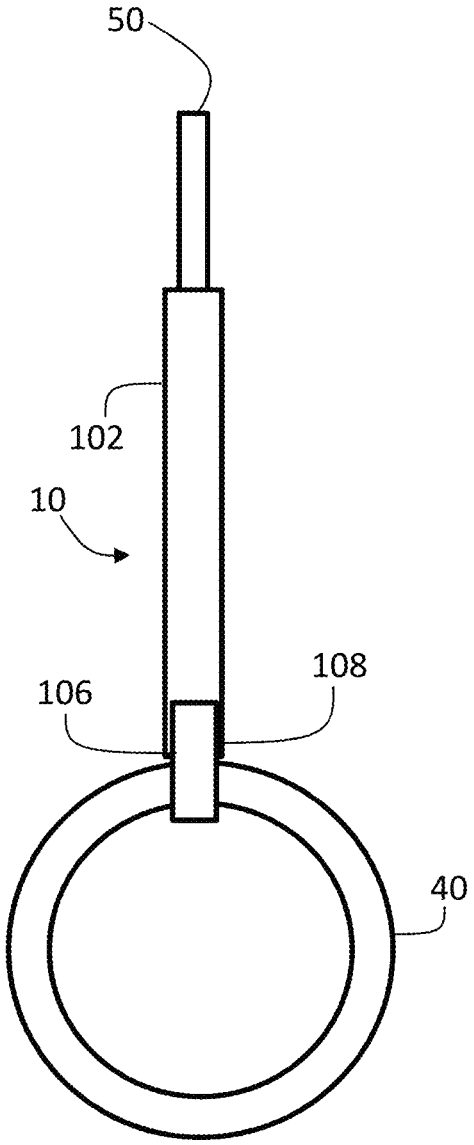

FIGS. 10-12 show a further embodiment in which the ring guard 100 comprises a sleeve 102. The sleeve 102 has an interior 104 which is configured to receive the strap 50 of the gymnastics ring 40 at a first open end 106 of the sleeve. Adjacent the first open end 106 of the sleeve 102, there is a loop 108. The loop 108 has a distal end with a releasable connector 110. The loop distal end releasable connector 110 may be releasably connectable with the sleeve 102 at the first open end 106. The sleeve may have a releasable connector 112 that cooperates with the loop distal end releasable connector 110. In this way, the loop 108 may be directed through an inner diameter of the gymnastics ring 40 and releasably connected to the sleeve 102, thereby allowing the loop to hold the sleeve in position relative to the gymnastics ring 40 and the gymnastics ring strap 50. As shown in FIGS. 11-12, the loop distal end releasable connector 110 secures to the releasable connector 112 on the outer surface of the sleeve 102. The loop distal end releasable connector may also secure to the interior 104 of the sleeve 102. Accordingly, the releasable connector provided on the sleeve may be formed in the interior the sleeve and the releasable connector provided on the distal end of the loop may be reversed from the configuration shown in FIG. 11 so as to allow the loop to be inserted in the interior 104 of the sleeve 102 and to allow the loop distal end releasable connector to releasably connect to the sleeve releasable connector. The loop may be more permanently attached to the sleeve at the open end 106 through stitching or other integral/monolithic connection with the sleeve. In the alternative, both ends of the loop (i.e., the distal end as shown and the opposite end) may have releasably connections (e.g., hook and loop connections) with the sleeve.

In the foregoing description, it is to be understood that the terms indicating the orientation or the positional relationship are based on the orientation or positional relationship shown in the drawings, are merely for the convenience of describing the embodiments and simplifying the description rather than indicating or implying that the structure indicated must have a specific orientation and be constructed in a specific orientation, and thus are not to be construed as limiting.

In the foregoing description, it should be noted that the orientation or positional relationship indicated by the terms "top", "bottom", "center", "upper", "lower", "left", "right", "vertical", "horizontal", "inside" and "outside" are based on the orientation or positional relationship shown in the drawings, or the orientation or positional relationship that the product according to the disclosed embodiments is conventionally placed when in use, are merely for the convenience of describing the embodiments and simplifying the description rather than indicating or implying that the device or element indicated must have a specific orientation and be constructed and operated in a specific orientation, and thus are not to be construed as limiting.

While the present invention has been illustrated by the description of exemplary embodiments thereof, and while the embodiments have been described in certain detail, it is not the intention of the Applicant to restrict or in any way limit the scope of the appended claims to such detail. Additional advantages and modifications will readily appear to those skilled in the art. Therefore, the invention in its broader aspects is not limited to any of the specific details, representative devices and methods, and/or illustrative examples shown and described. Accordingly, departures may be made from such details without departing from the spirit or scope of the applicant's general inventive concept.

We claim:

1. A ring guard comprising:

a pliant member having a top side and a bottom side, the pliant member having a width and a length, the pliant member having a first longitudinal edge extending along the length and a second longitudinal edge extending along the length across the width, the pliant member having a first releasable connector adjacent the first longitudinal edge on the top side of the pliant member, the pliant member having a second releasable connector adjacent the second longitudinal edge on the bottom side of the pliant member, the second releasable connector being releasably connectable with the first releasable connector; and a tab having a top side and a bottom side, the tab having a length with a first portion and an opposite second edge spaced from the tab first portion across the tab length, the tab having a first releasable connector adjacent the second edge of the tab on the top side of the tab, the tab having a second releasable connector adjacent the tab second edge of the tab on the bottom side of the tab, the first releasable connector of the tab being releasably connectable with the second releasable connector of the pliant member, the second releasable connector of the tab being releasably connectable with the first releasable connector of the pliant member.

2. The ring guard of claim 1 wherein the first and second releasable connectors of the pliant member comprises loop and hook material, respectively.

3. The ring guard of claim 2 wherein the first and second releasable connectors of the tab comprise loop and hook material, respectively.

4. The ring guard of claim 1 wherein the first portion of the tab extends from the width of the pliant member.

5. The ring guard of claim 1 wherein the pliant member is rectangular.

6. A ring guard comprising a pliant member, the pliant member having a top side and a bottom side, the pliant member having first and second width edges and first and second length edges extending between the respective first and second width edges, the pliant member having a releasable connector on the top side of the pliant member, the pliant member having a releasable connector on the bottom side of the pliant member, the pliant member being formable into a sleeve by releasably joining the length edges of the pliant member together with the releasable connector of the top side of the pliant member being releasably connected to the releasable connector of the bottom side of the pliant member, when the pliant member is formed into the sleeve, the first width edge being configured to receive a strap of a gymnastics ring into an interior of the sleeve, the second width edge having a loop, the loop having a distal end with a releasable connector, the releasable connector of the distal end of the loop being releasably connectable with the releasable connector of the bottom side of the pliant member at the second width edge in a manner such that when the loop is directed through an inner diameter of the gymnastics ring, the loop holds the sleeve in position relative to the gymnastics ring with the distal end of the loop secured in the interior of the sleeve.

7. The ring guard of claim 6 wherein the releasable connector of the top side of the pliant member is adjacent to the first longitudinal edge of the pliant member and the releasable connector of the bottom side of the pliant member is adjacent to the second longitudinal edge of the pliant member.

8. The ring guard of claim 7 wherein the releasable connectors of the top side and the bottom side of the pliant member comprise hook and loop material, respectively.

9. The ring guard of claim 6 wherein the pliant member is rectangular.

10. A method comprising:

providing a gymnastics ring, the gymnastics ring being coupled to a strap;

accessing a pliant member, the pliant member having a top side and a bottom side, the pliant member having a width and a length, the pliant member having a first longitudinal edge extending along the length and a second longitudinal edge extending along the length across the width;

arranging the strap over the pliant member with the strap extending in a direction corresponding to the length of the pliant member;

with the first longitudinal edge, folding the pliant member over the strap to form a first folded over region of the pliant member;

accessing a tab, the tab having a top side and a bottom side, the tab having a length with a first portion and an opposite second edge spaced from the first portion of the tab across the length of the tab;

directing the tab through an inner diameter of the gymnastics ring;

releasably connecting the tab at the second edge of the tab to the first folded over region of the pliant member such that the tab abuts the gymnastics ring;

with the second longitudinal edge, folding the pliant member over the strap to form a second folded over region;

releasably connecting at least a portion of the second folded over region to at least a portion of the first folded over region with the at least portion of the second folded over region covering the at least portion of the first folded over region and the tab.

11. The method of claim 10 wherein releasably connecting the portion of the second folded over region to the portion of the first folded over region comprises releasably connecting a releasable connector adjacent the second longitudinal edge on the second folded over region of the pliant member to the portion of the first folded over region of the pliant member.

12. The method of claim 11 wherein releasably connecting the releasable connector adjacent the second longitudinal edge on the second folded over region of the pliant member to the portion of the first folded over region of the pliant member comprises releasably connecting the releasable connector to a further releasable connector on the first folded over region of the pliant member.

13. The method of claim 12 wherein releasably connecting the tab at the second edge of the tab to the first folded over region of the pliant member comprises releasably connecting a releasable connector on the top side of the tab to the further releasable connector on the first folded over region of the pliant member.

14. The method of claim 12 wherein releasably connecting the portion of the second folded over region to the portion of the first folded over region includes releasably connecting the releasable connector adjacent the second longitudinal edge on the second folded over region of the pliant member to a further releasable connector on the bottom side of the tab.

15. The method of claim 10 wherein directing the tab through the inner diameter of the gymnastics ring comprises directing the second edge of the tab through the inner diameter of the gymnastics ring with the first portion of the tab extending from the width of the pliant member.

* * * * *